United States Patent [19]

Vander Kooi et al.

[11] 4,375,907

[45] Mar. 8, 1983

[54] FLIPPER DOOR ASSEMBLY

[75] Inventors: David Vander Kooi; Donald Flamboe, Jr., both of Holland, Mich.

[73] Assignee: Trendway Corporation, Holland, Mich.

[21] Appl. No.: 213,991

[22] Filed: Dec. 8, 1980

[51] Int. Cl.[3] ..... A47F 3/00; E05D 15/56

[52] U.S. Cl. ..... 312/109; 312/110; 312/138 R; 312/323; 49/197

[58] Field of Search ..... 312/109, 110, 322, 323, 312/138 R, 331; 49/197

[56] References Cited

U.S. PATENT DOCUMENTS

| | | | |
|---|---|---|---|
| Re. 28,994 | 10/1976 | Aylworth | 312/138 R |
| 487,150 | 11/1892 | Ohmer | 312/323 |
| 776,195 | 11/1904 | McClure | 312/109 |
| 934,239 | 9/1909 | Trost | 312/109 |
| 1,115,345 | 10/1914 | Steuernagel | 312/109 |
| 1,529,601 | 3/1925 | Lyons | 49/197 |
| 1,698,509 | 1/1929 | Probert | 312/109 |
| 2,110,176 | 3/1938 | Rogers | 312/323 |
| 2,258,948 | 10/1941 | Garrison | 312/109 |
| 3,339,995 | 9/1967 | Bencene | 312/322 |
| 3,446,546 | 5/1969 | D'Adamo | 312/323 |
| 3,456,995 | 7/1969 | Nyquist | 312/322 |
| 3,620,588 | 11/1971 | Ferdinand | 312/323 |
| 3,748,005 | 7/1973 | Chovanec et al. | 312/109 |
| 3,794,401 | 2/1974 | Dean et al. | 312/323 |

FOREIGN PATENT DOCUMENTS

| | | | |
|---|---|---|---|
| 189530 | 6/1937 | Switzerland | 312/138 R |
| 17962 | of 1899 | United Kingdom | 312/110 |
| 302122 | 12/1928 | United Kingdom | 312/109 |
| 369779 | 3/1932 | United Kingdom | 312/109 |

*Primary Examiner*—Victor N. Sakran

*Attorney, Agent, or Firm*—Waters, Lesniak & Willey

[57] ABSTRACT

A flipper door assembly for use on a cabinet or the like. A generally rectangular door sized to cover the desired cabinet opening is suspended by a rack and pinion suspension mechanism. The rack and pinion suspension mechanism includes a pair of gear racks mounted in the cabinet opening and a corresponding pair of pinion gears located above the gear racks and engageable therewith. The pinion gears are connected to each other by an axle shaft. Hinges are mounted to the upper inside surface of the door with the hinge pivots parallel to the top of the door. The ends of the hinges mounted to the door are flat and the other ends are L-shaped with the outermost end of each hinge being rotatably mounted on the axle shaft. Guide channels are provided for the door parallel with and below the gear racks so that the door can be opened from a closed vertical position by lifting the door to pivot it via the hinge pivots to the horizontal position in parallel alignment with the guide channels, followed by pushing the door into the guide channels while the pinion gears traverse the gear racks until the door is contained within the cabinet.

3 Claims, 4 Drawing Figures

FLIPPER DOOR ASSEMBLY

BACKGROUND OF THE INVENTION

1. Field of the Invention

The present invention relates to cabinet closures, and, more particularly, to a flipper door assembly for cabinets and the like.

2. Description of the Prior Art

A wide variety of door closures for cabinets and the like are in use today. In instances where space is a problem or for aesthetics, many applications have provided for doors which when open are contained in the cabinet itself. Curtain doors, folding doors, and roll away doors are but a few examples. However, there has been a continuing need for a door which when open is out of the way, occupies a minimum of space, and does not require complex and expensive construction. For example, flipper doors have enjoyed new widespread use in which a cabinet door is pivoted open from the closed position and then slid into the interior of the cabinet. While conceptually satisfactory, those currently commercially available have suffered from several disadvantages. In some cases, the mechanisms employed are so cumbersome that they use up valuable cabinet space. In other instances, where attempts have been made to simplify the mechanism, the flipper door cannot be inserted into the cabinet far enough so that the bottom edge thereof is out of the way. Thus, there is a present need for a flipper door assembly which is simple, reliable, economical and which permits the door to be fully opened, out of the way, and contained within the cabinet while utilizing a minimum of cabinet space.

SUMMARY OF THE INVENTION

According to the present invention there is provided a flipper door assembly for use on a cabinet or the like. The flipper door is sized to cover the desired cabinet opening and is suspended by a rack and pinion suspension mechanism. The rack and pinion suspension mechanism comprises a pair of gear racks mounted in the cabinet opening on either side thereof and perpendicular to and above the top of the door when the door is in the closed position. A pair of pinion gears are located above the gear racks and engage the gear racks. The pinion gears are in turn connected to each other by an axle shaft.

Hinges having one generally flat end are mounted by the flat end to the upper inside surface of the door with the hinge pivots parallel to the top of the door. The other end of each of the hinges is L-shaped and the outermost end of each hinge is rotatably mounted on the axle shaft which connects the pinion gears.

A pair of guide channels for the door is mounted in the cabinet below and parallel with the gear racks so that the door can be opened from the closed vertical position by lifting the door to pivot it via the hinge pivots to the horizontal position in parallel alignment with the guide channels. Once in the horizontal position, the door is pushed into the guide channels while the pinion gears traverse the gear racks until the door is contained within the cabinet.

Preferably, extruded mounting members, which comprise an upwardly facing U-shaped channel and an upwardly facing C-shaped channel, are utilized on either side of the cabinet to both mount the gear racks in the upper U-shaped channel and to utilize the inwardly facing C-shaped channel to provide the requisite guide channel for the door. Further, it is preferred that the front of the cabinet be provided with a depending lip which is wide enough to hide from view the rack and pinion mechanism of the flipper door assembly both when the door is fully opened and fully closed.

DESCRIPTION OF THE PREFERRED EMBODIMENTS

Figure 1:
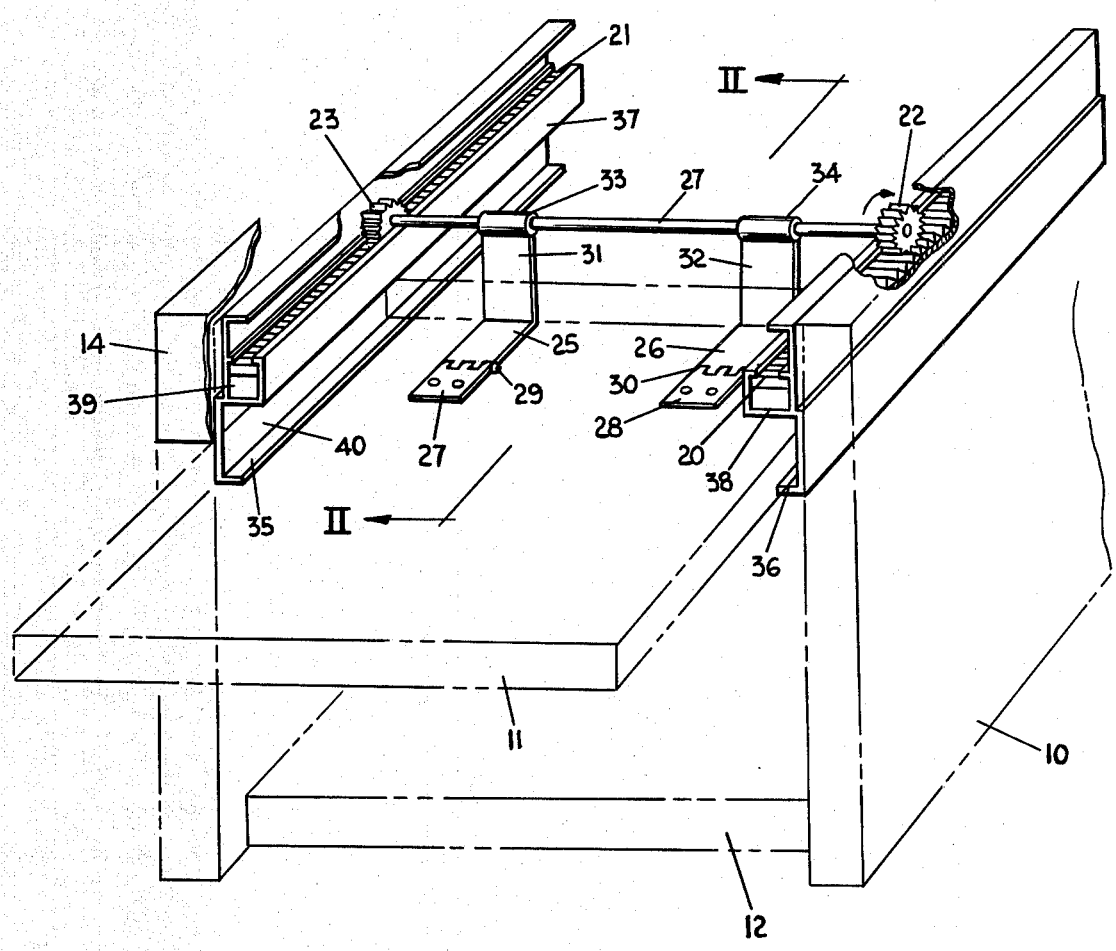
FIG. 1 is a perspective view of a cabinet having a flipper door assembly according to the present invention with cut away portions to expose the gear racks and pinion gears and with the cabinet and flipper door shown in phantom.

Referring to the drawings in greater detail, FIG. 1 is a perspective view of the flipper door assembly of the present invention installed in cabinet 10 shown in phantom. Flipper door 11 is shown in phantom in the horizontal open position partially pushed into cabinet 10. Flipper door 11 is sized to cover opening 12 of cabinet 10 when in the vertical or closed position. Flipper door 11 is suspended by a rack and pinion suspension mechanism which includes a pair of gear racks 20 and 21 which are mounted in the upper portion of the opening 12 in cabinet 10 on either side thereof above door 11 and perpendicular thereto when door 11 is in the vertical or closed position.

Pinion gears 22 and 23 are mounted above gear racks 20 and 21, respectively, to be engageable therewith. Pinion gears 22 and 23 are connected by axle shaft 24.

Figure 2:
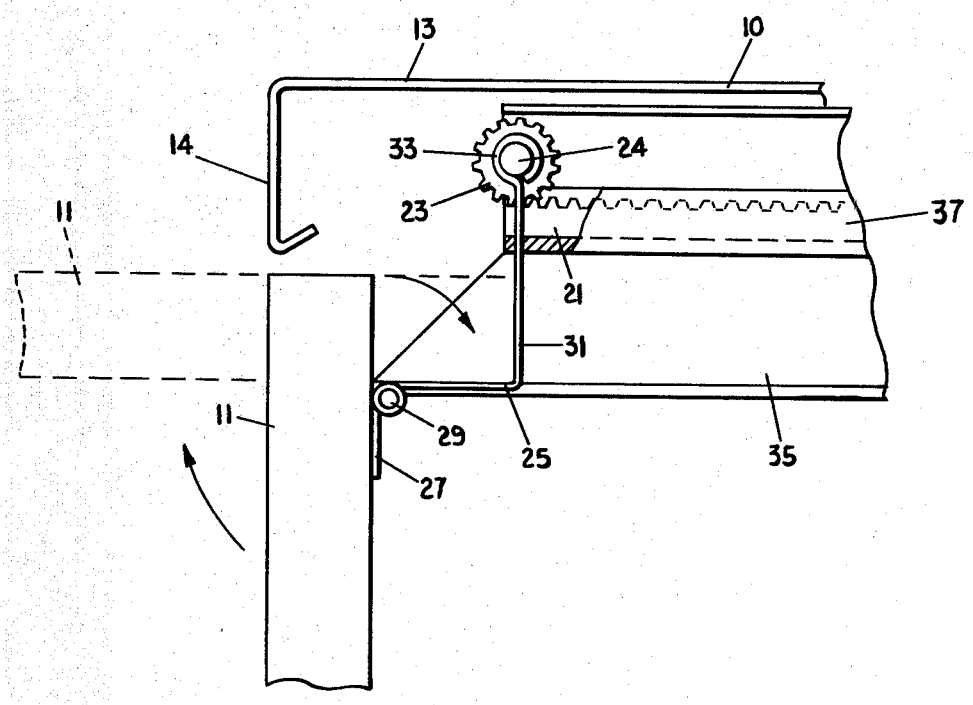
FIG. 2 is a side elevational partial cross-sectional view of the flipper door with its rack and pinion suspension mechanism taken along the line II—II of FIG. 1.

Hinges 25 and 26 have ends 27 and 28, respectively, which are flat and are secured to the inside of flipper door 11 so that hinge pivots 29 and 30 are parallel to the top of flipper door 11. The other end of each of hinges 25 and 26 is L-shaped, and the outermost ends 33 and 34, respectively, are rotatably mounted on axle shaft 24. As shown in FIGS. 1 and 2, the hinges should be mounted below the top of door 11 so that when door 11 is in the horizontal position the end legs of the hinges are adjacent to the top of the door.

Guide channels 35 and 36 are mounted in the cabinet below and parallel with gear racks 21 and 20, respectively, to guide door 11 as it is slid horizontally in and out of cabinet 10.

For economy of construction and ease of assembly, it is preferred to use extruded members 37 and 38 to both mount gear racks 21 and 20 and to provide the guide channels 35 and 36. Thus, as shown, extruded members 37 and 38 comprise an upwardly facing U-shaped channel 39 and an inwardly facing C-shaped channel 40. With this construction, the extruded members 37 and 38 can be easily glued or otherwise conventionally attached to the inner side walls of cabinet 10 with gear racks 21 and 20 in position. Flipper door 11, with hinges and pinion gears in place, is then just simply inserted to engage the pinion gears with the rack gears and assembly of the flipper door assembly is complete.

As best shown in FIG. 2, it is preferred that the top surface 13 of cabinet 10 have a depending lip portion 14 extending across the face of cabinet 10 to a point just above the top of door 11. Depending lip 14 serves to hide from view the rack and pinion assembly both when the door is closed as in FIGS. 2 and 3, as well as when the door is open as in FIGS. 1 and 4.

Figure 3:
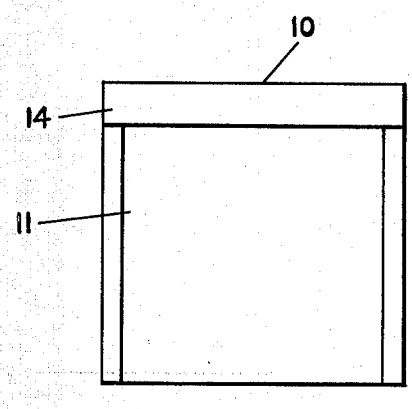
FIG. 3 is a front elevational view of a cabinet with the flipper closed.
Figure 4:
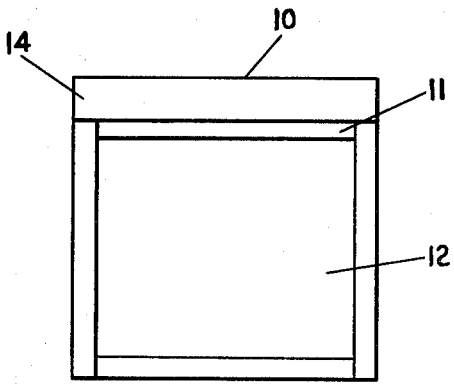
FIG. 4 is a front elevational view of a cabinet with the flipper open.

To open the flipper door when it is in the closed position as shown in FIGS. 2 and 3, the door is lifted from the vertical position to the horizontal position (shown in phantom in FIG. 2) in the direction of the arrows pivoting on hinge pivots 29 and 30. Once in the horizontal position, door 11 is then pushed rearwardly into and toward the back of cabinet 10 until the bottom edge thereof is flush with depending lip 14 or protruding slightly in the case of doors with raised key locks at the bottom of the door. Because of the unique arrangement of the rack and pinion mechanism, the hinges and flipper door 11, flipper door 11 can be as wide as cabinet opening 12 and as deep as cabinet 10 since no room is needed on the sides or at the back for any of the mechanisms employed. All of the mechanism is efficiently concealed above flipper door 11 and behind lip 14 resulting in literally no wasted space. Also very important in the flipper door assembly of the present invention is the fact that a two point pivot is provided with each hinge, i.e., hinge pivots 29 and 30, respectively, and rotatably mounted ends 33 and 34, respectively. The advantage of this double acting pivot action on each hinge is that door 11 is more easily and smoothly pivoted from the vertical to the horizontal position and is self-aligning as it is pushed into guide tracks 35 and 36 to fully open the door without jamming.

Thus, the flipper door assembly of the present invention is simple and economical to construct and assemble, provides smooth operation and utilizes a minimum of space in the cabinet, while the gear mechanisms are totally hidden from view for aesthetic purposes. Although the preferred embodiments of the present invention have been described and illustrated, it will be obvious to those skilled in the art that various changes and modifications may be made without departing from the spirit of the present invention. Accordingly, the scope of the present invention is deemed to be limited only by the following appended claims.

The embodiments of the invention in which an exclusive property or privilege is claimed are defined as follows:

1. A flipper door assembly for use on a cabinet or the like comprising:

a generally rectangular door sized to cover the desired cabinet opening;

a rack and pinion suspension mechanism for suspending said door which comprises a pair of gear racks mounted in said cabinet opening on either side thereof and perpendicular to and above the top of said door when in the closed position; and a pair of pinion gears above and engaging said gear racks and connected to each other by an axle shaft;

at least one hinge with one end of said hinge being generally flat and mounted to the upper inside surface of said door with the hinge pivot parallel to the top end of said door; the other end of said hinge being L-shaped with the outermost end being rotatably mounted on said axle shaft; and a pair of guide channels for said door mounted in said cabinet below and parallel with said gear racks, whereby said door is opened from the closed vertical position by lifting the door to pivot it via said hinge pivot to the horizontal position in parallel alignment with said guide channels followed by pushing said door into said guide channels while said pinion gears traverse said gear racks until said door is contained within said cabinet.

2. The flipper door assembly according to claim 1 wherein said cabinet has a depending lip extending across the face thereof from the cabinet top to a point adjacent the top of said flipper door whereby said hinge and said rack and pinion mechanism are hidden from view.

3. The flipper door assembly according to claim 1 further comprising a pair of extruded members mounted in said cabinet on either side thereof, each of said members comprising an upwardly facing U-shaped channel and an inwardly facing C-shaped channel, said gear racks being mounted in said U-shaped channels and said C-shaped channels functioning as said door guide channels.

* * * * *